US011796192B2

(12) United States Patent
Shaffer et al.

(10) Patent No.: US 11,796,192 B2
(45) Date of Patent: Oct. 24, 2023

(54) AIR CONDITIONING APPLIANCE WITH EXTERNAL MAKE-UP AIR MODULE

(71) Applicant: Haier US Appliance Solutions, Inc., Wilmington, DE (US)

(72) Inventors: Timothy Scott Shaffer, La Grange, KY (US); Stephen D. Hatcher, Henryville, IN (US); Richard Michael Phillips, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 305 days.

(21) Appl. No.: 16/565,787

(22) Filed: Sep. 10, 2019

(65) Prior Publication Data

US 2021/0071881 A1 Mar. 11, 2021

(51) Int. Cl.

| | |
|---|---|
| ***F24F 1/027*** | (2019.01) |
| ***F24F 1/028*** | (2019.01) |
| ***F24F 13/20*** | (2006.01) |
| ***F24F 1/0358*** | (2019.01) |

(52) U.S. Cl.

CPC ..... *F24F 1/027* (2013.01); *F24F 1/028* (2019.02); *F24F 1/0358* (2019.02); *F24F 13/20* (2013.01); *F24F 2013/202* (2013.01); *F24F 2013/205* (2013.01)

(58) Field of Classification Search

CPC .. F24F 1/027; F24F 1/028; F24F 13/20; F24F 1/0358; F24F 2013/205; F24F 2013/202; F24F 1/0035; F24F 3/1405

See application file for complete search history.

(56) References Cited

U.S. PATENT DOCUMENTS

| | | | | |
|---|---|---|---|---|
| 4,281,522 | A * | 8/1981 | Bussjager | F24F 1/0323 62/409 |
| 4,513,809 | A * | 4/1985 | Schneider | F24F 12/001 165/909 |
| 9,927,134 | B2 | 3/2018 | Beilfuss et al. | |
| 10,041,743 | B2 * | 8/2018 | Heberer | F28D 21/0001 |
| 2013/0023196 | A1 * | 1/2013 | Fisher | F24F 13/10 55/385.2 |
| 2015/0258488 | A1 * | 9/2015 | Meirav | F24F 7/065 96/144 |
| 2016/0363333 | A1 * | 12/2016 | Meirav | F24F 8/22 |

(Continued)

FOREIGN PATENT DOCUMENTS

WO WO2019033707 A1 2/2019

*Primary Examiner* — Frantz F Jules
*Assistant Examiner* — Martha Tadesse
(74) *Attorney, Agent, or Firm* — Dority & Manning, P.A.

(57) ABSTRACT

A single-package air conditioning appliance includes a housing defining an outdoor portion and an indoor portion. An outdoor heat exchanger assembly is disposed in the outdoor portion. The outdoor heat exchanger assembly includes an outdoor heat exchanger and an outdoor fan. An indoor heat exchanger assembly is disposed in the indoor portion. The indoor heat exchanger assembly includes an indoor heat exchanger and an indoor fan. A compressor is in fluid communication with the outdoor heat exchanger and the indoor heat exchanger to circulate a refrigerant between the outdoor heat exchanger and the indoor heat exchanger. The single-package air conditioner unit also includes a make-up air module mounted on an external surface of the housing.

15 Claims, 7 Drawing Sheets

(56) References Cited

U.S. PATENT DOCUMENTS

| | | | | |
|---|---|---|---|---|
| 2018/0187907 | A1* | 7/2018 | Meirav | F24F 11/58 |
| 2018/0347836 | A1 | 12/2018 | Fradkin | |
| 2019/0008076 | A1* | 1/2019 | Ghadiri Moghaddam | H05K 7/20745 |

* cited by examiner

AIR CONDITIONING APPLIANCE WITH EXTERNAL MAKE-UP AIR MODULE

FIELD OF THE INVENTION

The present subject matter relates generally to air conditioning appliances, and more particularly to make-up air modules for air conditioning appliances.

BACKGROUND OF THE INVENTION

Air conditioner or air conditioning appliance units are conventionally utilized to adjust the temperature within structures such as dwellings and office buildings. In particular, one-unit type room air conditioner units, such as single-package vertical units (SPVU), or package terminal air conditioners (PTAC) may be utilized to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through, for example, the indoor portion of the air conditioner unit. One or more control boards are typically provided to direct the operation of various elements of the particular air conditioner unit.

Make-up air, e.g., additional fresh air from outside of the building, is typically provided either with a large separate system remote from the air conditioner or with make-up air components internal to the air conditioner. Conventional separate systems can be costly. Conventional internal systems must be relatively small due to limited volume within the air conditioner, which may result in limited capacity of the make-up air system.

As a result, further improvements to air conditioners may be advantageous. In particular, it would be useful to provide an air conditioner with an integrated make-up air module.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a single-package air conditioner unit, e.g., an SPVU or PTAC, is provided. The single-package air conditioner unit defines a mutually-perpendicular vertical direction, lateral direction, and transverse direction. The single-package air conditioner unit includes a housing defining an outdoor portion and an indoor portion. An outdoor heat exchanger assembly is disposed in the outdoor portion. The outdoor heat exchanger assembly includes an outdoor heat exchanger and an outdoor fan. An indoor heat exchanger assembly is disposed in the indoor portion. The indoor heat exchanger assembly includes an indoor heat exchanger and an indoor fan. A compressor is in fluid communication with the outdoor heat exchanger and the indoor heat exchanger to circulate a refrigerant between the outdoor heat exchanger and the indoor heat exchanger. The single-package air conditioner unit also includes a make-up air module positioned on an outside of the housing.

In another exemplary aspect of the present disclosure, a single-package air conditioner unit is provided. The single-package air conditioner unit includes a housing that defines an interior and an exterior. A thermodynamic assembly is disposed within the interior of the housing. A make-up air module is positioned on the exterior of the housing.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
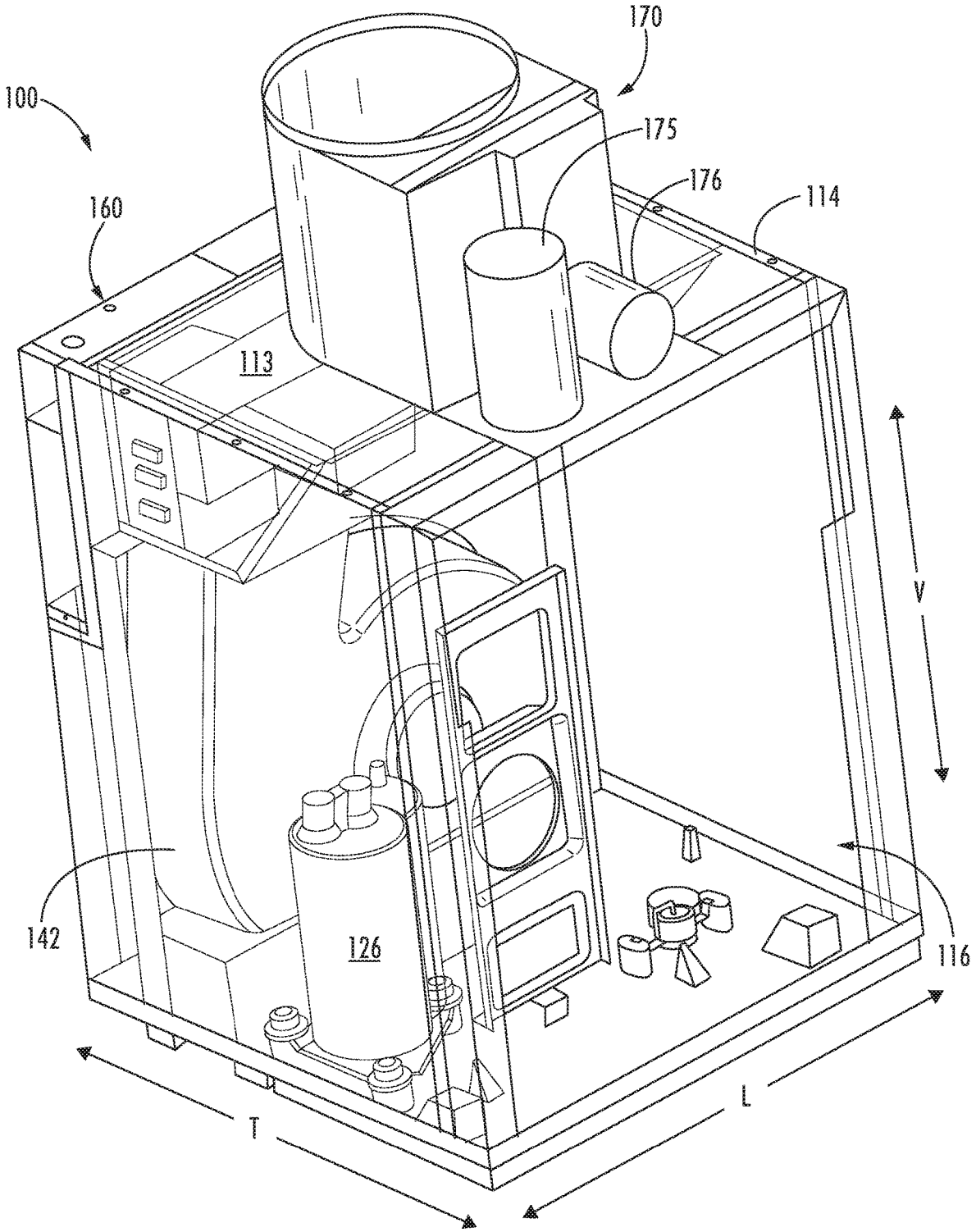
FIG. 1 provides a transparent perspective view of an air conditioning appliance according to one or more exemplary embodiments of the present disclosure.
Figure 2:
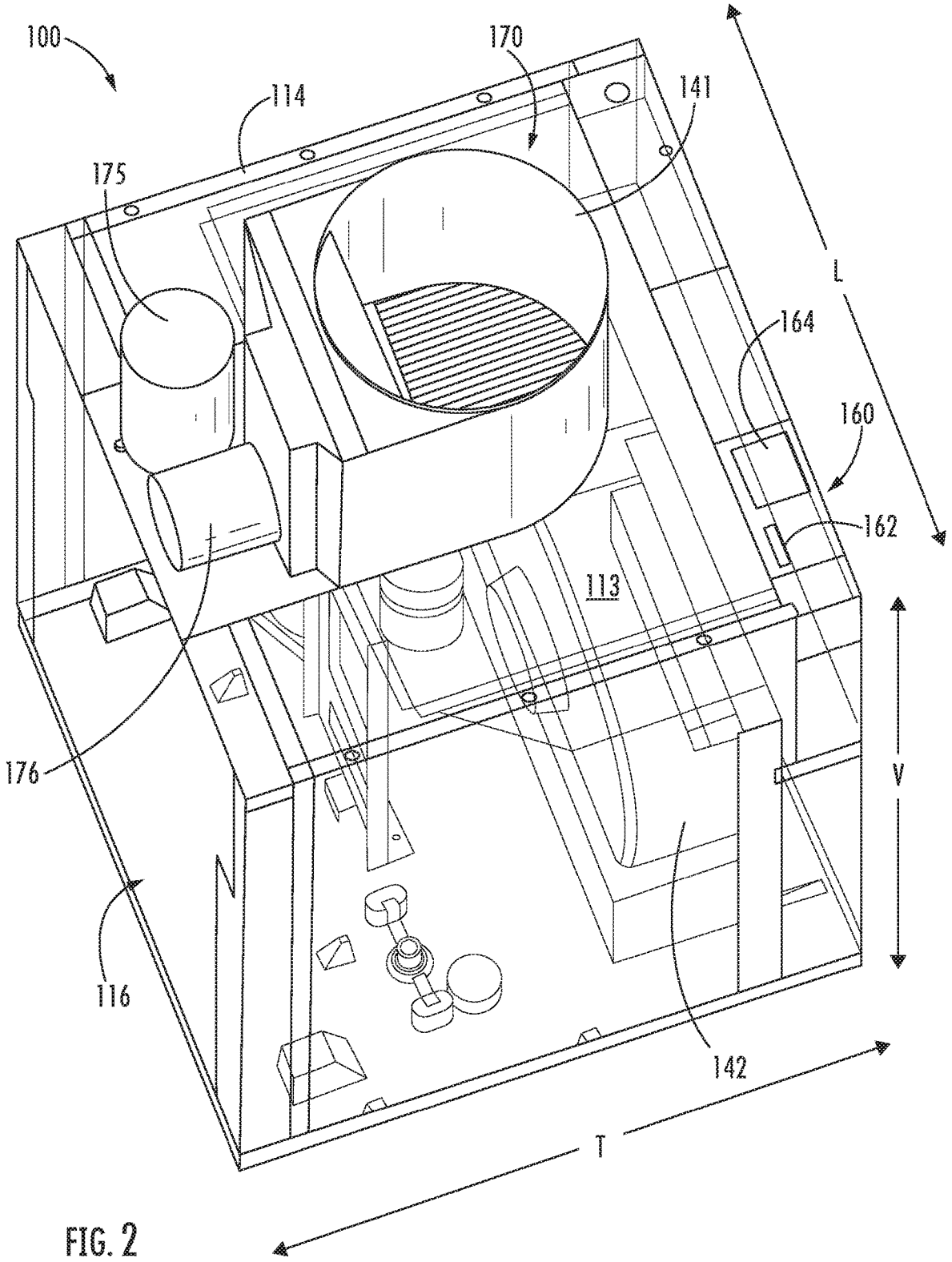
FIG. 2 provides an additional transparent perspective view of the exemplary air conditioner unit of FIG. 1.
Figure 3:
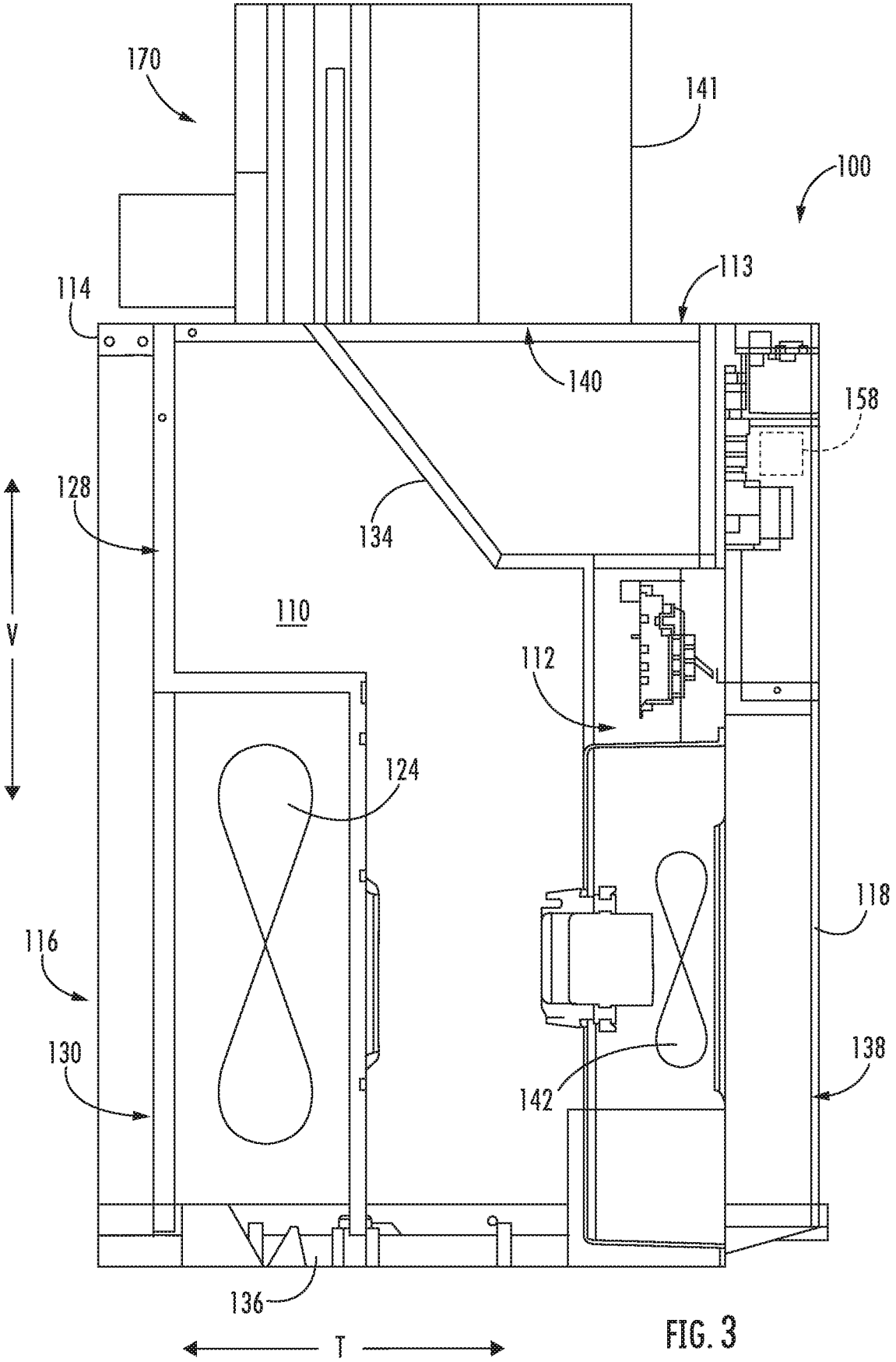
FIG. 3 provides a transparent side view of the exemplary air conditioner unit of FIG. 1.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Turning now to the figures, FIGS. 1 through 3, 5 and 6 illustrate an exemplary air conditioner appliance (e.g., air conditioner 100). In some embodiments, the air conditioner 100 may be provided as a one-unit type air conditioner 100, such as a single-package vertical unit (SPVU), as illustrated, or a package terminal air conditioners (PTAC). Throughout the discussion herein, references to a "single-package air conditioner unit" are to be understood as referring to any suitable one-unit type air conditioner appliance, such as but not limited to an SPVU or a PTAC. Air conditioner 100 includes a package housing 114 supporting an indoor portion 112 and an outdoor portion 110 within an interior of the housing 114. A make-up air module 170 is positioned on an outside or exterior of the housing 114, e.g., on an external surface 113 of the housing 114, such as on a vertically upward facing top external surface 113, whereby the make-up air module 170 is mounted atop the housing 114.

Generally, air conditioner 100 defines a vertical direction V, lateral direction L, and transverse direction T. Each direction V, L, T is perpendicular to every other of the V, L, and T directions, such that an orthogonal coordinate system is generally defined.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) may be spaced apart from each other along the transverse direction T. The rear opening 116 may be part of the outdoor portion 110, while the front opening 118 is part of the indoor portion 112. Components of the outdoor portion 110, such as an outdoor heat exchanger 120, outdoor fan 124, and compressor 126 (FIG. 6) may be enclosed within housing 114 between front opening 118 and rear opening 116. In certain embodiments, one or more components of outdoor portion 110 are mounted on a basepan 136, as shown.

During certain operations, outdoor air 1000 (FIG. 6) may be drawn to outdoor portion 110 through rear opening 116. Specifically, an outdoor inlet 128 defined through housing 114 may receive outdoor air 1000 motivated by outdoor fan 124. Within housing 114, the received outdoor air 1000 may be motivated through or across outdoor fan 124. Moreover, at least a portion of the outdoor air 1000 may be motivated through or across outdoor heat exchanger 120 (FIG. 6) before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable discrete orientation.

As shown, indoor portion 112 may include an indoor heat exchanger 122 and a blower fan 142. These components may, for example, be housed behind the front opening 118. A bulkhead 134 may generally support or house various other components or portions thereof of the indoor portion 112, such as the blower fan 142. Bulkhead 134 may generally separate and define the indoor portion 112 and outdoor portion 110 within housing 114. Additionally or alternatively, bulkhead 134 or indoor heat exchanger 122 may be mounted on basepan 136 (e.g., at a higher vertical position than outdoor heat exchanger 120).

During certain operations, indoor air 1002 (FIG. 6) may be drawn to indoor portion 112 through front opening 118. Specifically, an indoor inlet 138 defined through housing 114 may receive indoor air 1002 motivated by blower fan 142. At least a portion of the indoor air 1002 may be motivated through or across indoor heat exchanger 122 (e.g., before passing to bulkhead 134). From blower fan 142, indoor air 1002 may be motivated and returned to the indoor area of the room through an indoor outlet 140 defined through housing 114 (e.g., above indoor inlet 138 along the vertical direction V) and into a vertical exhaust duct 141 extending upward along the vertical direction V from the housing 114. Optionally, one or more conduits (not pictured) may be mounted to or downstream from exhaust duct 141 to further guide air from air conditioner 100. It is noted that although indoor outlet 140 is illustrated as generally directing air 1002 upward, it is understood that indoor outlet 140 and exhaust duct 141 may be defined in alternative embodiments to direct air 1002 in any other suitable direction.

Outdoor and indoor heat exchanger 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

Figure 6:
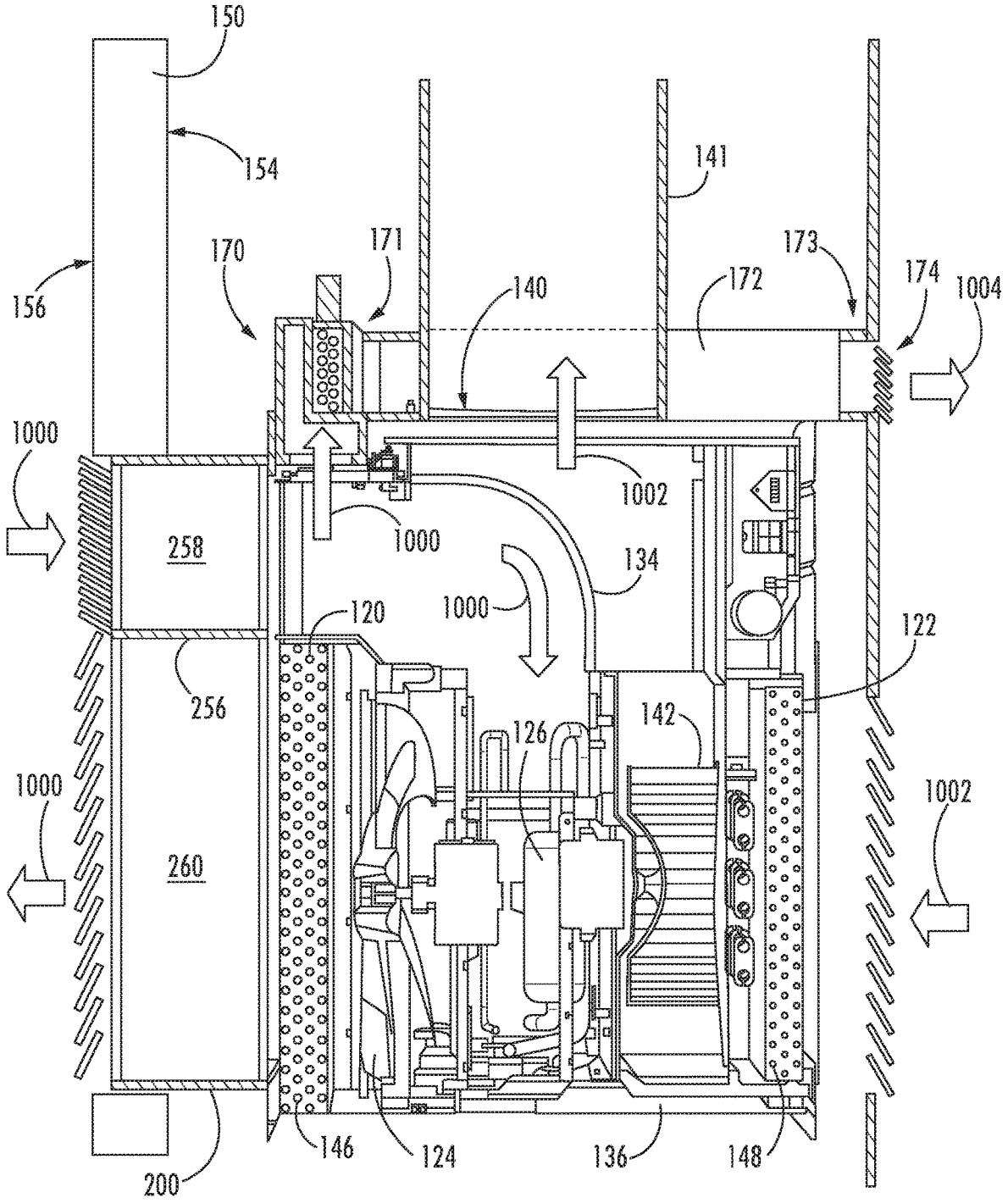
FIG. 6 provides a cross section view of the exemplary air conditioner unit of FIG. 5.

The sealed system may, for example, further include compressor 126 (e.g., mounted on basepan 136, as illustrated in FIG. 6) and an expansion device (e.g., expansion valve or capillary tube—not pictured), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

Additionally, a plenum 200 (FIG. 6) may be provided to direct air to or from housing 114. When installed, plenum 200 may be selectively attached to (e.g., fixed to or mounted against) housing 114 (e.g., via a suitable mechanical fastener, adhesive, gasket, etc.) and extend through a structure wall 150 (e.g., an outer wall of the structure within which air conditioner 100 is installed). In particular, plenum 200 extends along an axial direction (e.g., parallel to the transverse direction T) through a hole or channel in the structure wall 150 that passes from an internal (indoor) surface 154 of the structure wall 150 to an external (outdoor) surface 156 of the structure wall 150. The plenum 200 may include a divider wall 256 within the plenum 200. When assembled, divider wall 256 defines a separate upper passage 258 and lower passage 260. Generally, upper passage 258 and lower passage 260 may divide or define two discrete air flow paths for air through the plenum 200. When assembled, upper passage 258 and lower passage 260 may be fluidly isolated by divider wall 256 (e.g., such that air is prevented from passing directly between passages 258 and 260 through divider wall 256, or another portion of plenum 200). Upper passage 258 may be positioned upstream from outdoor inlet 128. Lower passage 260 may be positioned downstream from outdoor outlet 130.

The operation of air conditioner 100 including compressor 126 (and thus the sealed system generally), blower fan 142, outdoor fan 124, and other suitable components may be controlled by a control board or controller 158. Controller 158 may be in communication with (e.g., connected to, via for example a suitable wired or wireless connection) such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 and one or more user inputs 162 (FIG. 2), which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Figure 4:
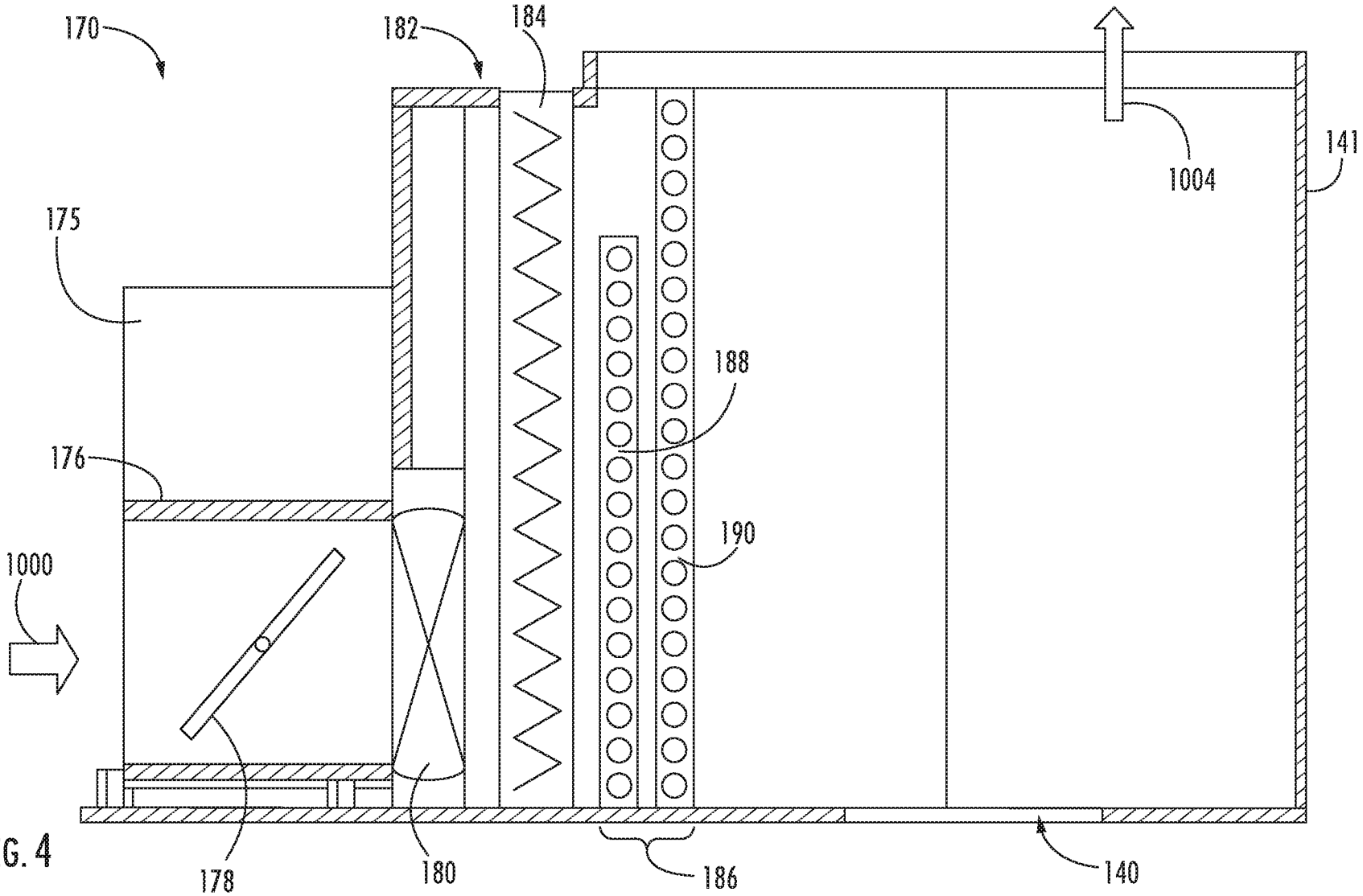
FIG. 4 provides a section view of a make-up air module mounted on a top exterior surface of a housing of the exemplary air conditioner unit of FIG. 1.

Turning now to FIG. 4, an exemplary make-up air module 170 according to one or more example embodiments of the present disclosure is shown in greater detail. As may be seen in FIG. 4, the make-up air module 170 may include an intake duct 176 with a motorized damper 178 therein (the motorized damper 178 is illustrated in an intermediate position between an open position and a closed position of the damper 178 in FIG. 4). In some embodiments, the make-up air module 170 may be in direct fluid communication with an outdoor environment to draw outdoor air 1000 directly from the outdoor environment into the make-up air module 170, e.g., through the intake duct 176.

The outdoor air 1000 may be urged into and through the intake duct 176 by a fan 180. The fan 180 may further urge the air 1000 through an air filter 184. The air filter 184 may be removably inserted into the make-up air module 170 through a slot 182. Thus, the air filter 184 may also be removed and replaced as needed via the slot 182. A dehumidifier 186 may be positioned downstream of the air filter 184. For example, as illustrated in FIG. 4, the dehumidifier may include an evaporator 188 and a condenser 190 downstream (with respect to the flow of air 1000) from the evaporator 188. A compressor 175 motivates refrigerant through and between the evaporator 188 and the condenser 190 such that, when the dehumidifier 186 is active, the evaporator 188 first cools the outdoor air 1000 such that water vapor in the air 1000 condenses into liquid water, then the condenser 190 warms the air and thereby lowers the relative humidity of the air, producing dehumidified, e.g., drier, make-up air 1004. In some embodiments, the make-up air 1004 may be provided from the make-up air module 170 to an indoor area (room or rooms) within the structure via the exhaust duct 141, e.g., as illustrated in FIG. 4. In some embodiments, the make-up air module 170 is in direct fluid communication with the vertical exhaust duct 141.

Figure 5:
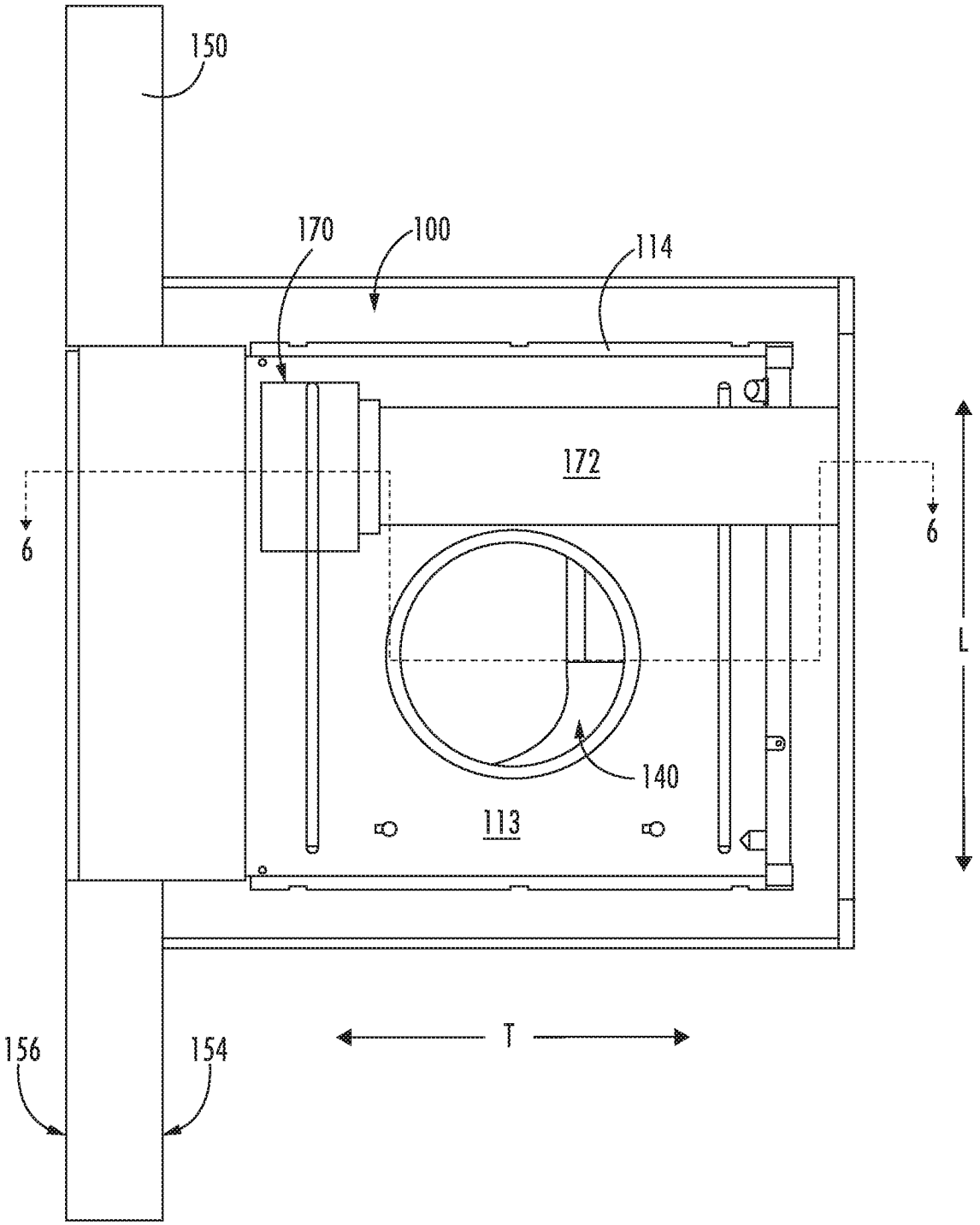
FIG. 5 provides a schematic, top-down view of an air conditioning appliance with a make-up air module mounted thereon according to one or more additional exemplary embodiments of the present disclosure.
Figure 7:
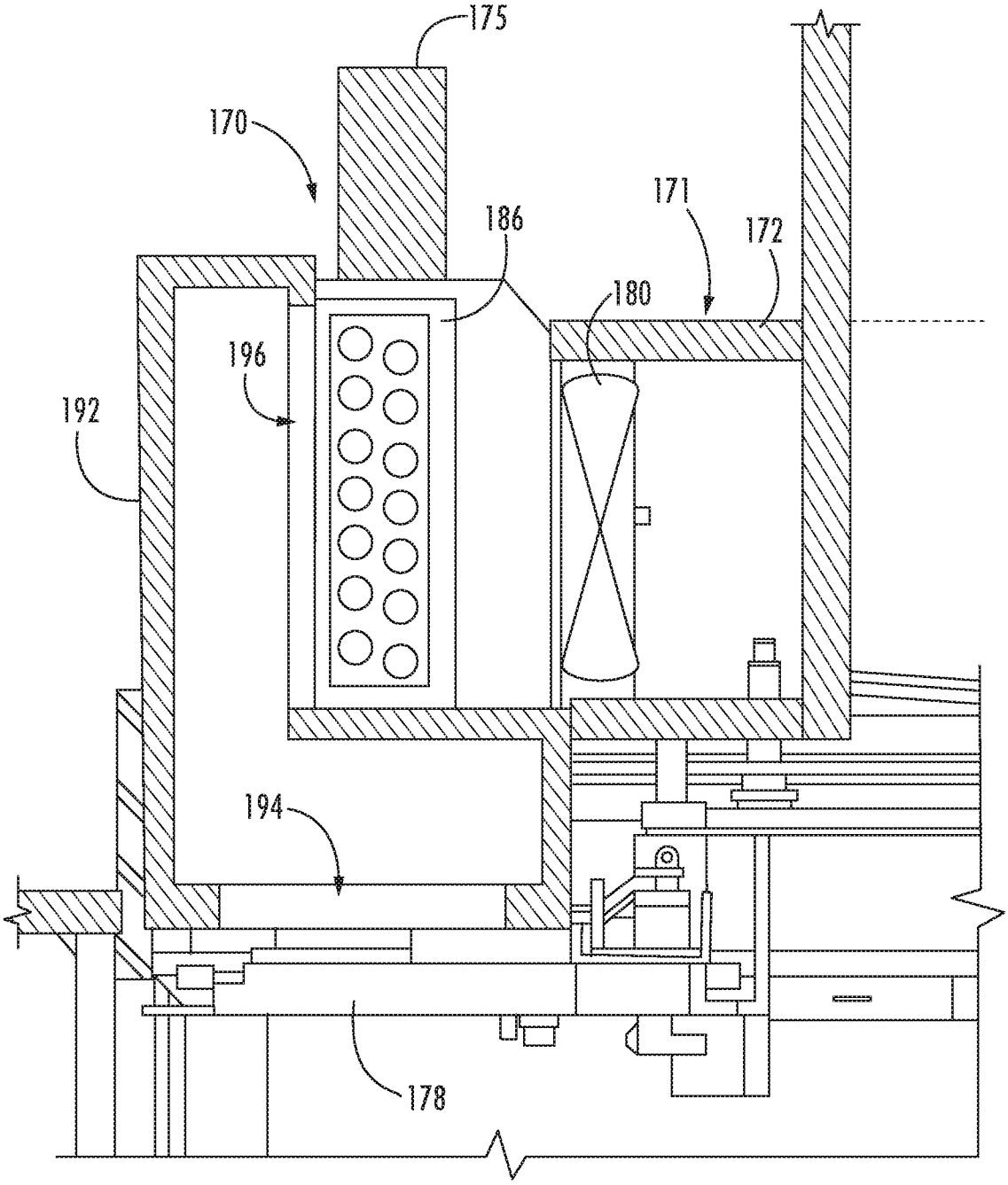
FIG. 7 provides an enlarged view of a portion of FIG. 6.

A make-up air module 170 according to one or more additional exemplary embodiments of the present disclosure is illustrated in FIGS. 5 through 7. FIG. 5 is a top-down view of the air conditioner 100 with the make-up air module 170 mounted on a top external surface 113 of the housing 114. FIG. 6 is a section view taken along the staggered section line 6-6 in FIG. 5. The section view of FIG. 6 is taken along a staggered line to better illustrate internal components of the air conditioner 100, such as the make-up air module 170 and the exhaust duct 141. FIG. 7 is an enlarged view of a portion of FIG. 6.

As may be seen in FIG. 6, in some embodiments, the make-up air module 170 may be in fluid communication with the outdoor portion 110 (FIG. 3) of the housing 114 to draw outside air 1000 from within the housing 114 into the make-up air module 170. For example, as may be seen in FIG. 7, some embodiments may include a transition box 192 which extends from an inlet 194 within the outdoor portion 110 of the housing 114 to an outlet 196 outside the housing 114. As illustrated in FIG. 7, the outlet 196 may be upstream of the make-up air module 170. Also illustrated in FIG. 7 is a motorized duct door or damper 178 which may be positioned at or near the inlet 194 of the transition box 192, e.g., between the inlet 194 of the transition box 192 and the outdoor portion 110 of the housing 114, to selectively permit or obstruct outdoor air 1000 (FIG. 6) flowing into the transition box 192 and to the make-up air module 170 from the outdoor portion 110 of the housing 114. As may be seen in FIG. 7, in some embodiments the fan 180 may be positioned downstream of the dehumidifier 186.

In some embodiments, e.g., as illustrated in FIGS. 6 and 7, the air conditioner 100 may also include a make-up air duct 172 positioned outside of the housing 114. The make-up air duct 172 may extend from an upstream end 171 connected to the make-up air module 170 to a downstream end 173 in fluid communication with an indoor environment such that make-up air 1004 (FIG. 6) is provided from the make-up air module 170 to the indoor environment via the make-up air duct 172. As may be seen in FIG. 6, the downstream end 173 of the make-up air duct 172 may be in fluid communication with the indoor environment through a vent 174, and the vent 174 may be separate from the housing 114.

Referring now generally to FIGS. 4, 6, and 7, operation of the exemplary make-up air modules 170 illustrated therein will be described. The operation of the make-up air module 170 may be controlled by controller 158 or by a separate and dedicated control board which is part of the make-up air module 170 and is integrated with the make-up air module 170.

The compressor 175 of the make-up air module 170 may be controlled based on input from an air humidity sensor (not shown). The air humidity sensor may be positioned in the outdoor portion 110 of the housing 114 or, in embodiments including the transition box 192, the air humidity sensor may be positioned within the transition box 192. When the humidity of the outdoor air 1000 exceeds a threshold, the compressor 175 may be activated in order to thereby activate the dehumidifier 186 and thereby reduce the humidity of the make-up air 1004 provided to the indoor environment as compared to the humidity of the outdoor air 1000. The threshold may be about fifty-five percent (55%) relative humidity, where "about" includes plus or minus ten percentage points of the stated value, e.g., about 55% includes between 45% and 65%. When the indoor room is not occupied, which may be detected by, e.g., the main control 158 or by an external control device, the motorized damper 178 is closed (e.g., actuated by the motor from the open position or an intermediate position to the closed position, where air flow into the make-up air module 170 is prevented or obstructed), the fan 180 is shut down, and the compressor 175 is deactivated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A single-package air conditioner unit defining a mutually-perpendicular vertical direction, lateral direction, and transverse direction, the single-package air conditioner unit comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger; and a make-up air module positioned outside of the housing, the make-up air module connected to a make-up air duct, the make-up air duct positioned outside of the housing whereby the make-up air duct bypasses the indoor portion of the single-package air conditioner unit, the make-up air duct extending from an upstream end connected to the make-up air module to a downstream end in direct fluid communication with an indoor environment, whereby make-up air is provided from the make-up air module to the indoor environment via the make-up air duct.

2. The single-package air conditioner unit of claim 1, wherein the make-up air module is in fluid communication with the outdoor portion of the housing to draw outside air from within the housing.

3. The single-package air conditioner unit of claim 2, wherein the make-up air module is in fluid communication with the outdoor portion of the housing via a transition box extending from an inlet within the outdoor portion of the housing to an outlet outside the housing and upstream of the make-up air module.

4. The single-package air conditioner unit of claim 3, further comprising a damper between the inlet of the transition box and the outdoor portion of the housing.

5. The single-package air conditioner unit of claim 1, wherein the make-up air module is in direct fluid communication with an outdoor environment to draw outdoor air directly from the outdoor environment.

6. The single-package air conditioner unit of claim 5, wherein the make-up air module is in direct fluid communication with the outdoor environment through an intake duct, further comprising a damper in the intake duct.

7. The single-package air conditioner unit of claim 1, wherein the make-up air module is mounted on an external surface of the housing.

8. The single-package air conditioner unit of claim 7, wherein the external surface of the housing is a vertically-facing surface and the make-up air module is mounted to the housing atop the housing.

9. The single-package air conditioner unit of claim 1, wherein the downstream end of the make-up air duct is in fluid communication with the indoor environment through a vent separate from the housing.

10. The single-package air conditioner unit of claim 1, wherein the make-up air module comprises a compressor, a dehumidifier, and a fan configured to urge air from an outdoor environment across the dehumidifier.

11. A single-package air conditioner unit, comprising:

a housing defining an interior and an exterior;

a thermodynamic assembly disposed within the interior of the housing; and a make-up air module positioned on the exterior of the housing, the make-up air module in direct fluid communication with an indoor environment through a make-up air duct positioned outside of the housing whereby the make-up air duct bypasses the housing and a vent separate from the housing.

12. The single-package air conditioner unit of claim 11, wherein the make-up air module is in fluid communication with an outdoor environment via the housing, whereby the make-up air module draws outdoor air into the make-up air module from within the housing.

13. The single-package air conditioner unit of claim 11, wherein the make-up air module is in direct fluid communication with an outdoor environment to draw outdoor air directly from the outdoor environment.

14. The single-package air conditioner unit of claim 11, further comprising an exhaust duct extending from the housing, wherein the make-up air module is in direct fluid communication with the exhaust duct.

15. The single-package air conditioner unit of claim 11, wherein the make-up air module comprises a compressor, a dehumidifier, and a fan configured to urge air from an outdoor environment across the dehumidifier.

* * * * *